US010757983B2

(12) United States Patent
Holdaway

(10) Patent No.: US 10,757,983 B2
(45) Date of Patent: Sep. 1, 2020

(54) NURSING BRASSIERE INCLUDING POSITIONABLE CUPS

(71) Applicant: Kaitlyn Holdaway, Kansas City, MO (US)

(72) Inventor: Kaitlyn Holdaway, Kansas City, MO (US)

( * ) Notice: Subject to any disclaimer, the term of this patent is extended or adjusted under 35 U.S.C. 154(b) by 106 days.

(21) Appl. No.: 16/183,865

(22) Filed: Nov. 8, 2018

(65) Prior Publication Data

US 2020/0146364 A1 May 14, 2020

(51) Int. Cl.
*A41C 3/04* (2006.01)
*A41F 15/00* (2006.01)
*A41C 3/00* (2006.01)

(52) U.S. Cl.
CPC ..... *A41C 3/04* (2013.01); *A41C 3/0035* (2013.01); *A41F 15/002* (2013.01)

(58) Field of Classification Search
CPC ..... A41C 3/04; A41C 3/0028; A41C 3/0035; A41C 3/0071; A41F 15/002; A41D 1/215
USPC ..... 450/36, 37, 58, 86
See application file for complete search history.

(56) References Cited

U.S. PATENT DOCUMENTS 2,386,531 A * 10/1945 Witkower ..... A41C 3/04 450/36
2,613,355 A * 10/1952 Coleman ..... A41C 3/04 450/36
3,002,515 A * 10/1961 Glogover ..... A41C 3/04 450/36
3,826,266 A * 7/1974 Alpert ..... A41C 3/0071 450/11
4,144,593 A 3/1979 Timmons
4,550,734 A 11/1985 Porco
4,648,404 A * 3/1987 Clark ..... A41C 3/08 2/104
5,611,086 A 3/1997 Eggen
6,156,065 A * 12/2000 Eaton ..... A41C 3/0071 450/54

(Continued)

FOREIGN PATENT DOCUMENTS

CN 103564818 A 2/2014
KR 19980010194 U 12/1995
WO 2017122031 A1 7/2017

OTHER PUBLICATIONS

US pregnant women Nursing Brestfeeing Bra Maternity Front Buckles Nursing Bra; Retrieved on Jun. 21, 2018: https://www.ebay.com/itm/US-Pregnant-Women-Nursing-Breastfeeding-Bra-Maternity-Front-Buckles-Nursing-Bra-/222770081108.

(Continued)

*Primary Examiner* — Jameson D Collier
*Assistant Examiner* — Jocelyn Bravo
(74) *Attorney, Agent, or Firm* — Armstrong Teasdale LLP

(57) ABSTRACT

A nursing brassiere generally comprises a band, a first cup, a second cup, a bridge, and straps. The cups are positionable between a support position and one or more nursing positions. Each cup includes a lower edge that is at least partially detached from the band when the first cup is in the nursing position. The straps are connected to the first cup and the second cup and the band to form loops sized to fit over shoulders of the wearer. The nursing brassiere also comprises coupling members attached to the cups, the straps, the band, and/or the bridge to allow the cups to be positioned in the support position and one or more nursing positions.

19 Claims, 6 Drawing Sheets

(56) References Cited

U.S. PATENT DOCUMENTS

| | | | | |
|---|---|---|---|---|
| 7,448,090 | B2 | 11/2008 | Lucock | |
| 7,878,881 | B2 | 2/2011 | Hendrickson | |
| 8,147,291 | B2 | 4/2012 | Hirtz | |
| 8,657,643 | B2 | 2/2014 | Perez et al. | |
| 8,668,547 | B2 | 3/2014 | Boonen et al. | |
| 9,402,425 | B2 | 8/2016 | Cortese et al. | |
| 2010/0261410 | A1* | 10/2010 | Hirtz | A41C 3/04 450/36 |
| 2013/0122780 | A1* | 5/2013 | McCall | A41C 3/08 450/30 |
| 2013/0232661 | A1 | 9/2013 | Huntley | |
| 2014/0087625 | A1* | 3/2014 | Ironi | A41C 3/04 450/36 |
| 2014/0342636 | A1 | 11/2014 | Johnson | |
| 2015/0351464 | A1 | 12/2015 | Getter et al. | |
| 2016/0106159 | A1* | 4/2016 | Yau | A41C 3/04 450/36 |
| 2018/0000168 | A1* | 1/2018 | Alva | A41D 1/215 |
| 2018/0132542 | A1 | 5/2018 | Abbaszadeh | |

OTHER PUBLICATIONS

Top 10 best Nursing bras 2018 Review Mommy Tea Room; Retrieved on Jun. 21, 2018: http://www.mommytearoom.com/best-nursing-bras/.

Cute lace plain design nursing bra—pink—summer glitz; Retrieved on Jun. 21, 2018: http://summerglitz.com.my/maternity-nursing-pregnancy-breastfeeding-clothes/nursing-blouse-breastfeeding-dress-nursing-shirt-nursing-singlet/nursing-bra-breastfeeding-brasleeping-ora/cute-lace-plain-design-nursing-bra-pink.html.

Best High Quality Breastfeeding Nursing Bra Women Clothing for Pregnant Cotton Maternity Clothes Underwear Lingerie Without Rims Wide Straps; Retrieved on Jun. 21, 2018: https://www.dhgate.com/product/high-quality-breastfeeding-nursing-bra-women/400061712.html.

* cited by examiner

NURSING BRASSIERE INCLUDING POSITIONABLE CUPS

BACKGROUND

The field of the disclosure relates generally to nursing brassieres, and, more specifically, to a nursing brassiere having positionable cups.

Brassieres are designed to cover and provide support for a wearer's breasts. Brassieres typically include two cups and one or more bands that extend around a torso of the wearer to secure the cups in position. Nursing women often need to access their breasts to extract milk and/or breastfeed a baby. Accordingly, some brassieres, i.e., nursing brassieres, are configured to facilitate nursing by allowing access to the breasts without the brassiere being completely removed. For example, nursing brassieres may include cups that open up by detaching a top of the cup and pulling the cup down. However, the nursing brassieres may still interfere with access to the breast when the cups are pulled down. For example, the opened cups may lie next to or on a baby that is being nursed and interfere with the nursing process. In addition, the nursing brassieres may not adequately support the breasts when the cups are opened.

Normally, nursing brassieres are worn underneath outer garments and the outer garments must be at least partially removed for nursing. A typical method to access the nursing brassiere for nursing is to raise an outer garment and access the nursing brassiere from the bottom of the garment. However, cups on typical nursing brassieres may be difficult to open from such a position because the cups are required to be pulled down. Another method to access the nursing brassiere is to pull a neckline of the outer garment downward towards the breasts. This method leads to an issue of breast exposure. In addition, the nursing woman may have at least one hand occupied while attempting to position her garments for nursing and the nursing brassieres may be difficult to access with one or more hands occupied.

Brassiere pads can be used with brassieres to increase comfort of the brassiere, to provide a desired shape to the breast, and/or to provide additional support. For example, some brassiere pads are inserted on the inside of the brassiere cup. However, it can be difficult to access and adjust the pad within the cups of brassiere when the brassiere is being worn.

Nursing pads can be used with brassieres to absorb fluids. For example, nursing pads can be positioned in a brassiere to absorb fluids excreted from the breasts. Accordingly, some nursing brassieres include a sling for receiving the pads. However, the pads may move or fall out of the brassiere when the cups are opened for accessing the breasts. In addition, it may be difficult to access and/or adjust pads that are positioned within the cups of the brassiere.

Accordingly, there is a need for an improved nursing brassiere that provides support for the wearer's breasts while providing easy access for a baby to nurse with less breast exposure.

BRIEF DESCRIPTION

In one aspect, a nursing brassiere generally comprises a band, a first cup, and a second cup. The band is arranged to extend around the body of a wearer and secure the brassiere to the wearer. The first cup is connected to the band and shaped to support a first breast of the wearer when the brassiere is secured to the wearer. The first cup is positionable between a support position, a first nursing position, and a second nursing position. The first cup includes a lower edge positioned under the first breast when the brassiere is secured to the wearer and the first cup is in the support position. The lower edge of the first cup is at least partially detached from the band when the first cup is in the first nursing position and the second nursing position. The second cup is connected to the band and shaped to support a second breast of the wearer when the brassiere is secured to the wearer. The second cup is positionable between a support position, a first nursing position, and a second nursing position. The second cup includes a lower edge positioned under the second breast when the brassiere is secured to the wearer and the second cup is in the support position. The lower edge of the second cup is at least partially detached from the band when the second cup is in the first nursing position and the second nursing position. The nursing brassiere also includes a bridge extending between the first cup and the second cup. The bridge is arranged to align with a sternum of the wearer when the brassiere is secured to the wearer. The nursing brassiere further includes a first strap connected to the first cup and the band to form a loop sized to fit over a first shoulder of the wearer and a second strap connected to the second cup and the band to form a loop sized to fit over a second shoulder of the wearer. The nursing brassiere also includes a plurality of coupling members. A first coupling member is attached to the first cup proximate the lower edge. A second coupling member is attached to the first strap. The second coupling member is arranged to engage the first coupling member and releasably secure the first cup in the first nursing position. A third coupling member is attached to the bridge. The third coupling member is arranged to engage the first coupling member and releasably secure the first cup in the support position. A fourth coupling member is attached to the band. The fourth coupling member is arranged to engage the first coupling member and releasably secure the first cup in the second nursing position. A fifth coupling member is attached to the second cup proximate the lower edge. A sixth coupling member is attached to the second strap. The second coupling member is arranged to engage the fifth coupling member and releasably secure the second cup in the first nursing position. A seventh coupling member is attached to the bridge. The seventh coupling member is arranged to engage the fifth coupling member and releasably secure the second cup in the support position. An eighth coupling member is attached to the band. The eighth coupling member is arranged to engage the fifth coupling member and releasably secure the second cup in the second nursing position.

In another aspect, a nursing brassiere generally comprises a band, a first cup, and a second cup. The band is arranged to extend around the body of a wearer and secure the brassiere to the wearer. The first cup is connected to the band and shaped to support a first breast of the wearer when the brassiere is secured to the wearer. The first cup is positionable between a support position and a nursing position. The first cup includes a lower edge positioned under the first breast when the brassiere is secured to the wearer and the first cup is in the support position. The lower edge of the first cup is at least partially detached from the band when the first cup is in the nursing position. The first cup includes an outer layer, an inner layer, and a liner extending between the outer layer and the inner layer. The liner and the outer layer define a first pocket to receive a first pad. The outer layer defines an opening for positioning the first pad into the first pocket. The liner and the inner layer define a second pocket to receive a second pad. The second cup is connected to the band and shaped to support a second breast of the wearer when the brassiere is secured to the wearer. The second cup is positionable between a support position and a nursing position. The second cup includes a lower edge positioned under the second breast when the brassiere is secured to the wearer and the second cup is in the support position. The lower edge of the second cup is at least partially detached from the band when the second cup is in the nursing position. The second cup includes an outer layer, an inner layer, and a liner extending between the outer layer and the inner layer. The liner and the outer layer define a third pocket to receive a third pad. The outer layer defines an opening for positioning the third pad into the third pocket. The liner and the inner layer define a fourth pocket to receive a fourth pad. The nursing brassiere also includes a bridge extending between the first cup and the second cup. The bridge is arranged to align with a sternum of the wearer when the brassiere is secured to the wearer. The nursing brassiere also comprises a first strap connected to the first cup and the band to form a loop sized to fit over a first shoulder of the wearer. The nursing brassiere further comprises a second strap connected to the second cup and the band to form a loop sized to fit over a second shoulder of the wearer.

DETAILED DESCRIPTION

Figure 1:
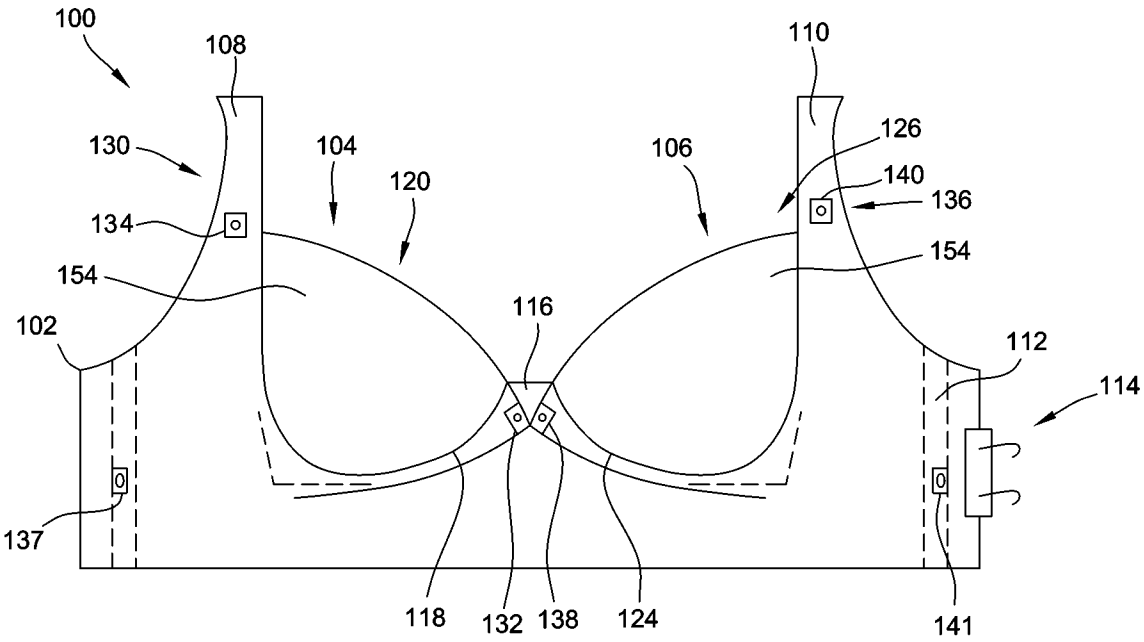
FIG. 1 is a front view of a nursing brassiere including cups in a support position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and preceded with the articles "a", "an", "the" and "said" should be understood as not excluding plural elements or steps, unless such exclusion is explicitly recited. The terms "comprising", "including" and "having" are intended to be inclusive and mean that there may be additional elements other than the listed elements.

The present disclosure provides a nursing brassiere including positionable cups. Each cup is positionable from a support position to a nursing position by moving at least a portion of the cup in a generally upward direction. Specifically, a lower edge of the positionable cup is at least partially detached from a band of the brassiere and a coupling member proximate the lower edge is released from a bridge of the brassiere to switch the brassiere from the support position to the nursing position. The coupling member may be releasably secured to a coupling member adjacent an apex of the cup to retain the positionable cup in the nursing position. As a result, the nursing brassiere may be easily switched between the support position and the nursing position using one hand. Moreover, the positionable cups are accessible underneath outer garments and cause less breast exposure than prior brassieres. Further, the positionable cups are positioned away from the nursing baby and do not interfere with access to the breasts when the positionable cups are in the nursing position. In addition, the nursing brassiere may include support portions that are positioned to support the wearer's breast when the positionable cups are in the nursing position. In some embodiments, the cups are positionable in a plurality of nursing positions.

Also, in some embodiments, the nursing brassiere may include one or more pockets for pads such as nursing pads and/or brassiere pads. For example, the nursing brassiere may include a first pocket defined between a liner and an outer layer. The outer layer may define an opening for positioning a brassiere pad within the first pocket. Accordingly, the pad may be inserted, removed, and repositioned from the exterior of the brassiere without removing the brassiere. The nursing brassiere may also include a second pocket defined between the liner and an inner layer. The inner layer may include an elastic member at least partially defining an opening for positioning a nursing pad within the second pocket. The elastic member retains the nursing pad within the second pocket and may prevent the nursing pad from being displaced when the cup is positioned between a nursing position and a support position.

Figure 2:
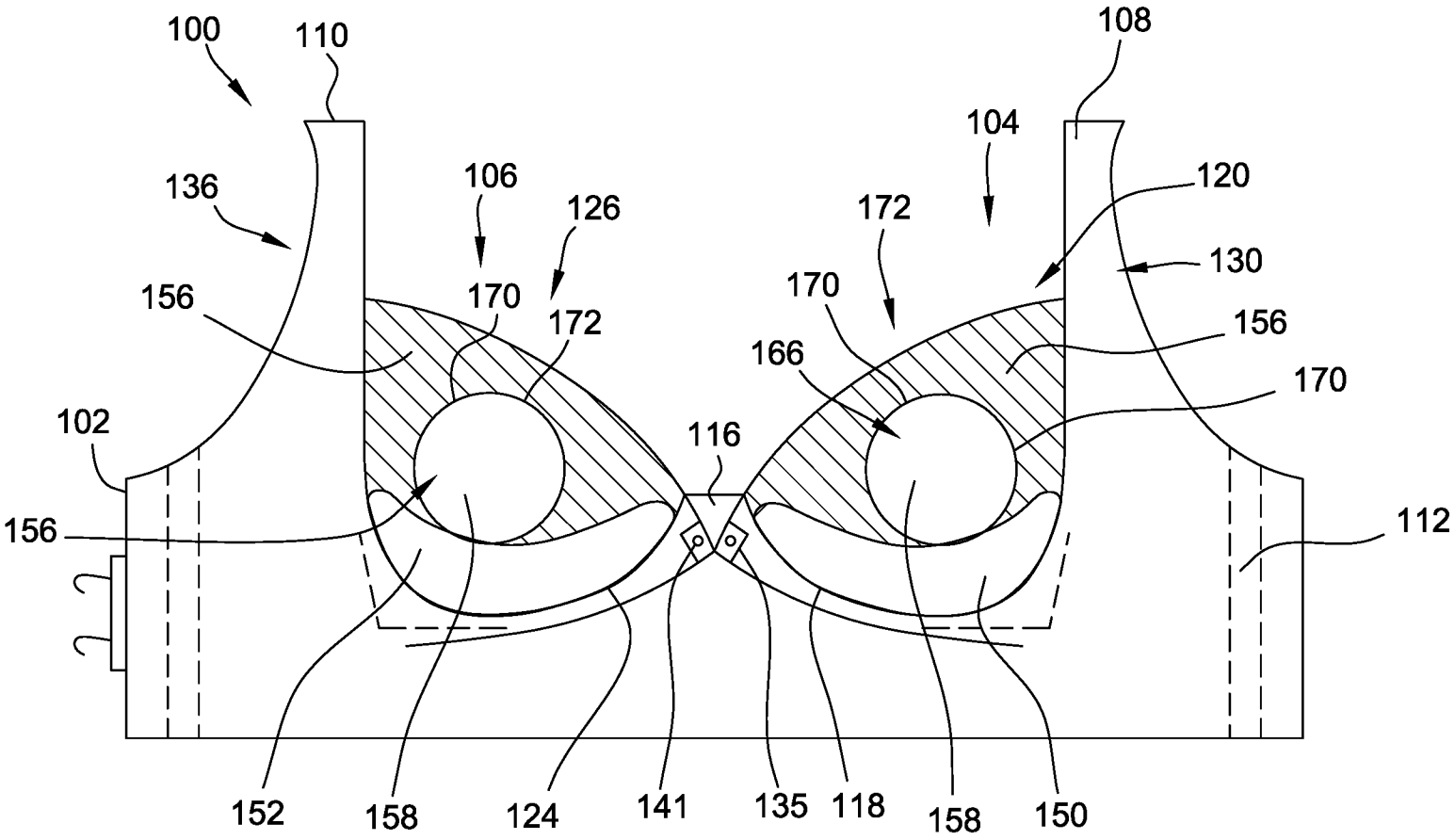
FIG. 2 is a rear view of the nursing brassiere shown in FIG. 1.
Figure 3:
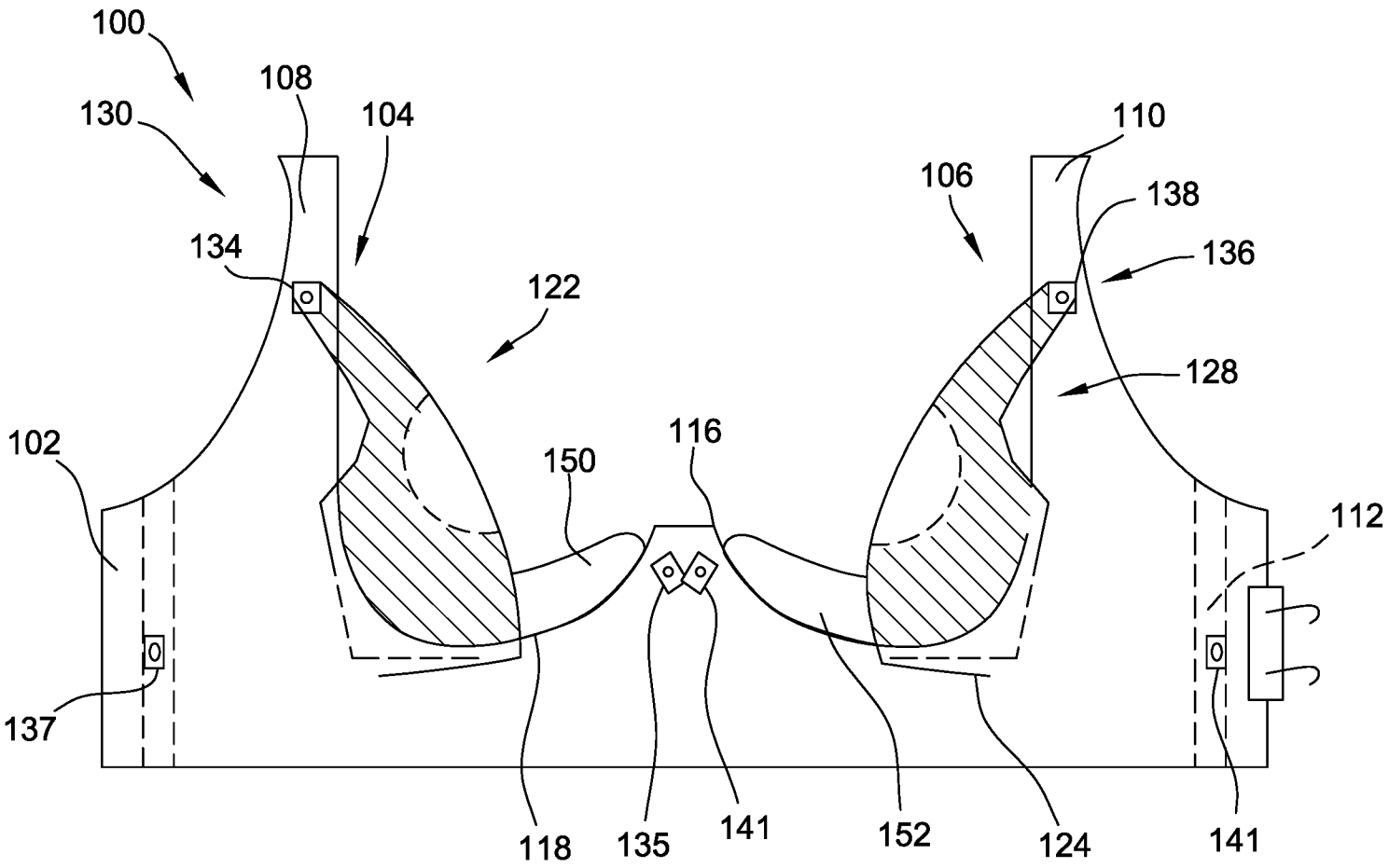
FIG. 3 is a front view of the nursing brassiere shown in FIGS. 1 and 2 with the cups in a first nursing position.

FIG. 1 is a front view of a nursing brassiere 100 including cups in a support position. FIG. 2 is a rear view of the nursing brassiere. FIG. 3 is a front view of the nursing brassiere 100 with the cups in a nursing position. The nursing brassiere 100 generally includes a band 102, a first cup 104, a second cup 106, a first strap 108, a second strap 110, a frame 112, and a closure member 114. In other embodiments, the nursing brassiere 100 may include other components without departing from some aspects of the disclosure.

The band 102 is arranged to extend around the body of a wearer and secure the brassiere to the wearer. Specifically, the band 102 encircles the torso of the wearer below the shoulders of the wearer. The band 102 is adjustable and may be adjusted to accommodate different size torsos. For example, the closure member 114 may be secured at multiple locations on band 102 to adjust the length of the band. In some embodiments, the band 102 may include an elastic material. In addition, the straps 108, 110 are arranged to extend over the shoulders of the wearer and retain the nursing brassiere 100 in position on the wearer. The band 102 includes a front middle or bridge 116 arranged to align with a sternum of the wearer when the brassiere 100 is secured to the wearer. Accordingly, the brassiere 100 is arranged to align with and at least partially cover the breasts of the wearer. In other embodiments, the nursing brassiere 100 may be secured to the wearer in any manner that enables the nursing brassiere to function as described herein.

Figure 7:
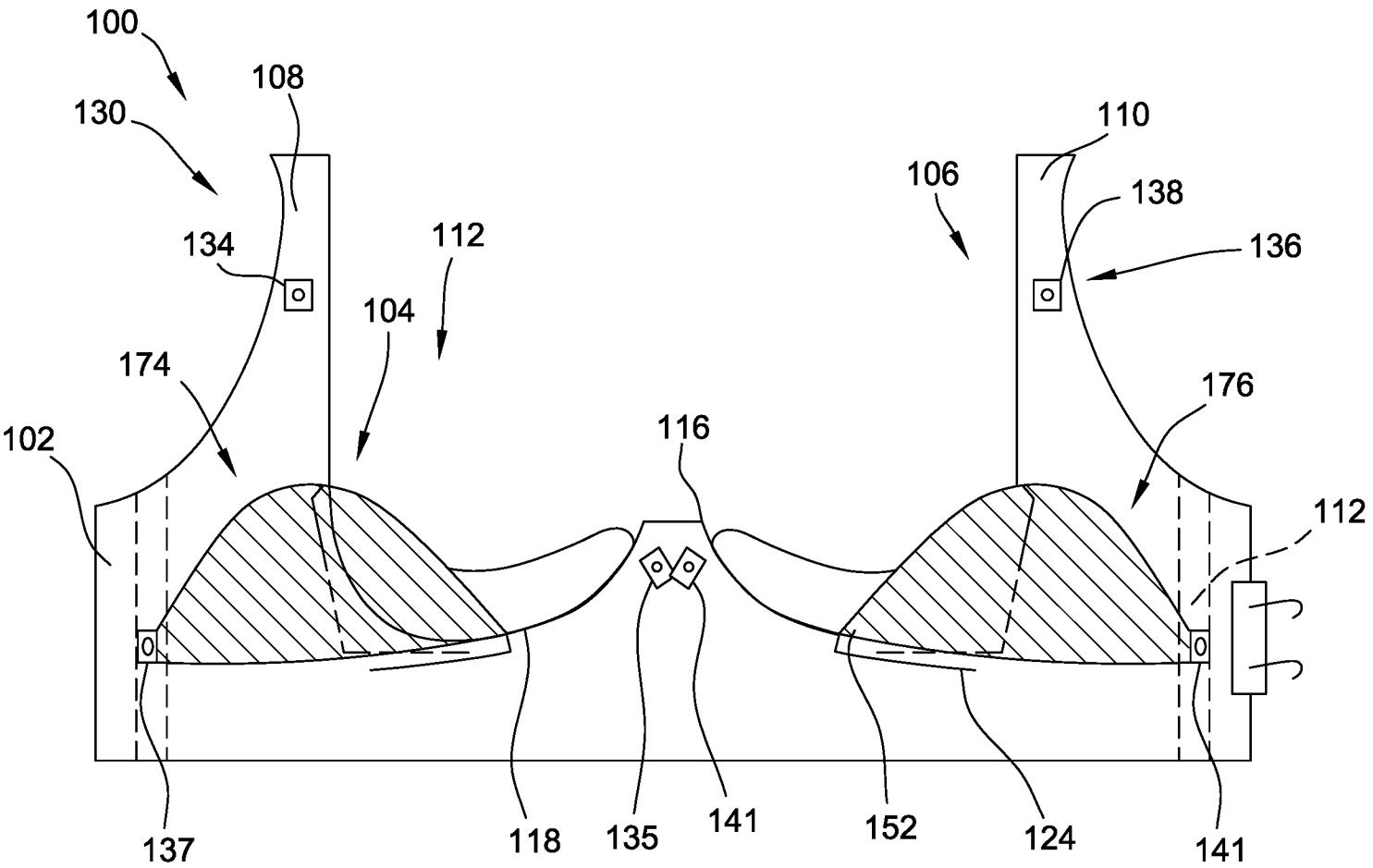
FIG. 7 is a front view of the nursing brassiere shown in FIGS. 1-3 with the cups in a second nursing position.

The first cup 104 and the second cup 106 each receive and support a breast of the wearer when the brassiere 100 is secured to the wearer and the bridge 116 is aligned with a sternum of the wearer. Specifically, the first cup 104 and the second cup 106 each include a concave inner surface that contacts the breast and transfers at least a portion of the weight of the breast through the brassiere 100. The bridge 116 extends between the first cup 104 and the second cup 106 and divides the brassiere into a first side and a second side. The first cup 104 is connected to the band 102 and located on the first side of the brassiere 100. The first cup 104 includes a first lower edge 118 arranged to extend under a breast of the wearer such that the first cup is arranged to support the breast when the brassiere 100 is secured to the wearer. The first cup 104 is positionable between a support position 120 (FIGS. 1 and 2), a first nursing position 122 (FIG. 3), and a second nursing position 174 (FIG. 7). The first lower edge 118 is at least partially detached from the band 102 when the first cup 104 is in the nursing position 122 and the second nursing position 174.

The second cup 106 is connected to the band 102 and located on the second side of the brassiere 100. The second cup 106 includes a second lower edge 124 arranged to extend under a breast of the wearer such that the second cup is arranged to support the breast when the brassiere 100 is secured to the wearer. The second cup 106 is positionable between a support position 126 (FIGS. 1 and 2), a first nursing position 128 (FIG. 3), and a second nursing position 176 (FIG. 7). The lower edge 124 is attached to the band 102 when the second cup 106 is in the support position 126 and is at least partially detached from the band when the second cup is in the first nursing position 128 and the second nursing position 176. In other embodiments, the cups 104, 106 may have any positions that enable the brassiere 100 to function as described herein. For example, in some embodiments, each cup 104, 106 may have more or less than two nursing positions.

The nursing brassiere also includes a first support portion 150 and a second support portion 152. The first cup 104 and the second cup 106 are at least partially detached from the band 102 along the lower edge when the cups are in the nursing position 122, 128. However, the first support portion 150 and the second support portion 152 remain attached to the band 102 and extend under the breast to support the breast when the respective cup 104, 106 is in the nursing position 122, 128. Suitably, the first support portion 150 is shaped such that the first support portion does not obstruct any portion of the breast in the nursing position 122, 128. For example, in the illustrated embodiment, the support portions 150, 152 are substantially smaller than the cups 104, 106 and extend along the band 102 adjacent the lower portion of the respective cup. Accordingly, the support portions 150, 152 are configured to extend under the breast of the wearer and do not obstruct access to the nipple of the breast. Moreover, the support portions 150, 152 extend outward from the band 102 along lower portions of the breasts. As a result, the first support portion 150 and the second support portion 152 allow access to the breast and still provide support to the breast when the respective cup 104, 106 is in the nursing position 122, 128.

In the illustrated embodiment, the first support portion 150 and the second support portion 152 are generally oval. Specifically, the first support portion 150 and the second support portion 152 are ovals with pointed ends forming an almond-shape. The first support portion 150 and the second support portion 152 are connected to the band 102 adjacent corners of the respective cups 104, 106 at locations spaced from the bridge 116. The first support portion 150 and the second support portion 152 extend along a lower portion and a side portion of the breast opening when the respective cup 104, 106 is in the nursing position 122, 128. Accordingly, the first support portion 150 and the second support portion 152 are shaped and positioned to support the breast when the respective cup 104, 106 is in the nursing position 122, 128. In other embodiments, the support portions 150, 152 may have other shapes and positions without departing from some aspects of the disclosure. For example, in some embodiments, the support portions 150, 152 may be semi-circular, crescent shaped, triangular, and/or polygonal.

The first strap 108 is connected to the first cup 104 on the first side of the brassiere 100 and is connected to the band 102 at a location spaced from the first cup. Accordingly, the first strap 108 forms a loop that is sized to extend over a shoulder of the wearer. The second strap 110 is connected to the second cup 106 on the second side of the brassiere 100 and is connected to the band 102 at a location spaced from the second cup. Accordingly, the second strap 110 forms a loop that is sized to extend over a shoulder of the wearer. In the illustrated embodiment, the first strap 108 and the second strap 110 are spaced apart from each other. In other embodiments, the first strap 108 and the second strap 110 may cross and/or be connected to each other. The first strap 108 and the second strap 110 may be adjustable to enable adjustment of the fit of the brassiere 100 on a wearer. In suitable embodiments, the brassiere 100 may include any straps 108, 110 that enable the brassiere to function as described. In some embodiments, the straps 108, 110 may be omitted and the brassiere 100 may be configured to support the wearer's breast in a configuration without the straps (i.e., a strapless configuration).

The nursing brassiere 100 includes a first connector 130 arranged to releasably connect the first cup 104 in the support position 120, the first nursing position 122, or the second nursing position 174. The first connector 130 comprises a first clip, broadly a coupling member, 132, a second clip, broadly a coupling member, 134, a third clip, broadly a coupling member, 135, and a fourth clip, broadly a coupling member, 137. The first clip 132 is attached to the first cup 104 along the lower edge 118 of the first cup 104. The second clip 134 is attached to the first strap 108 adjacent the apex of the first cup. The third clip 135 is attached to the bridge 116. In some embodiments, the third clip 135 may be attached to the band 102. The fourth clip 137 is attached to the band 102 and positioned on a side of the wearer. The first clip 132 and the second clip 134 are arranged to releasably engage and secure the first cup 104 in the first nursing position 128. The first clip 132 and the fourth clip 137 are arranged to releasably engage and secure the first cup 104 in the second nursing position 174. The first clip 132 and the third clip 135 are arranged to releasably engage and secure the second cup 106 in the support position 126.

In addition, the nursing brassiere 100 includes a second connector 136 arranged to releasably connect the second cup 106 in the support position 126, the first nursing position 128, or the second nursing position 176. The second connector 136 comprises a fifth clip, broadly a coupling member, 138, a sixth clip, broadly a coupling member, 140, a seventh clip, broadly a coupling member, 141, and an eighth clip, broadly a coupling member, 143. The fifth clip 138 is attached to the second cup 106 along the lower edge 124. The sixth clip 140 is attached to the second strap 110 adjacent the apex of the first cup. The seventh clip 141 is attached to the bridge 116. In some embodiments, the seventh clip 141 may be attached to the band 102. The eighth clip 143 is attached to the band 102 and positioned on a side of the wearer. The fifth clip 138 and the sixth clip 140 are arranged to releasably engage and secure the second cup 106 in the first nursing position 128. The fifth clip 138 and the eighth clip 143 are arranged to releasably engage and secure the second cup 106 in the second nursing position 176. The fifth clip 138 and the seventh clip 141 are arranged to releasably engage and secure the second cup in the support position 126.

The nursing brassiere 100 may include any connectors 130, 136 that enable the brassiere to function as described herein. For example, in some embodiments, the clips 132, 134, 135, 137, 138, 140, 141, 143 may include corresponding male and female components. To secure the clips, the male component of one clip is inserted into the female component of another clip and a flexible portion of one of the clips engages the other of the clips. To release the clips, an actuator may be pressed to displace the flexible portion and allow the male component to be removed from the female component. In some embodiments, the position of at least one of the clips 132, 134, 135, 137, 138, 140, 141, 143 on the nursing brassiere 100 is adjustable. In further embodiments, the first connector 130 and/or the second connector 136 may include any suitable coupling members including, for example and without limitation, clips, hook and loop fasteners, snaps, buttons, clasps, magnets, and any other suitable coupling members.

To switch the first cup 104 from the support position 120 to the nursing position 122, the first clip 132 is released from the third clip 135 and the first cup 104 is moved in a generally upward direction toward the apex of the first cup and the first strap 108. The first clip 132 is engaged with the second clip 134 to secure the first cup 104 in the nursing position 122. To switch the first cup 104 from the nursing position 122 to the support position 120, the first clip 132 is released from the second clip 134 and the first cup 104 is moved in a generally downward direction toward the bridge 116. The first clip 132 is engaged with the third clip 135 to secure the first cup 104 in the support position 120.

To switch the second cup 106 from the support position 126 to the nursing position 128, the fifth clip 138 is released from the seventh clip 141 and the second cup 106 is moved in a generally upward direction toward the apex of the second cup and the second strap 110. The fifth clip 138 is engaged with the sixth clip 140 to secure the second cup 106 in the nursing position 128. To switch the second cup 106 from the nursing position 128 to the support position 126, the fifth clip 138 is released from the sixth clip 140 and the second cup 106 is moved in a generally downward direction toward the bridge 116. The fifth clip 138 engaged with to the seventh clip 141 to secure the second cup 106 in the support position 126.

FIG. 7 is a front view of the nursing brassiere 100 with the cups in the second nursing positions 174, 176. To switch the first cup 104 from the support position to the second nursing position, the first clip 132 is released from the third clip 135 and the first cup 104 is moved in a generally horizontal direction toward the side of the nursing brassiere 100. The first clip 132 is engaged with the fourth clip 137 to secure the first cup 104 in the second nursing position 174. To switch the second cup 106 from the support position 126 to the second nursing position 176, the fifth clip 138 is released from the seventh clip 141 and the second cup 106 is moved in a generally horizontal direction toward the side of the nursing brassiere 100. The fifth clip 138 is engaged with the eighth clip 143 to secure the second cup 106 in the second nursing position 176.

The nursing brassiere 100 includes the frame 112 extending through at least a portion of the band 102 to provide stability for the brassiere and support for the breasts. For example, the frame 112 may include rigid bars that extend vertically through the band 102. The frame 112 may be constructed of, for example and without limitation, metal, plastic, and fiberglass. In other embodiments, the nursing brassiere 100 may include any suitable frame 112. For example, in some embodiments, the frame 112 may include underwire adjacent or within the cups 104, 106.

Figure 4:
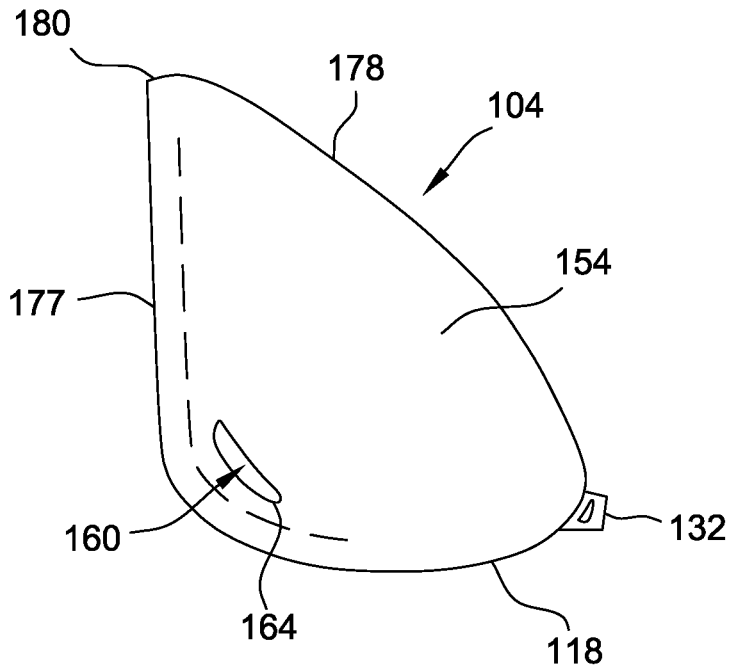
FIG. 4 is a front view of a cup of the nursing brassiere shown in FIGS. 1-3.
Figure 5:
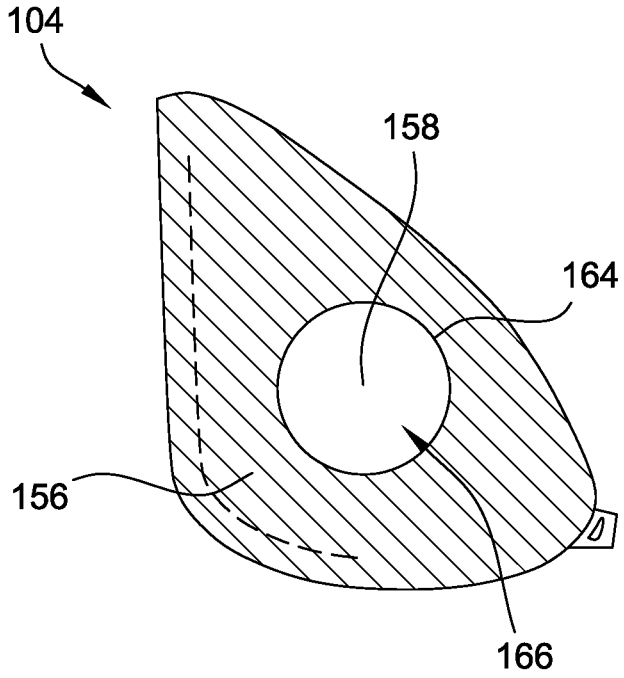
FIG. 5 is a rear view of the cup shown in FIG. 4.
Figure 6:
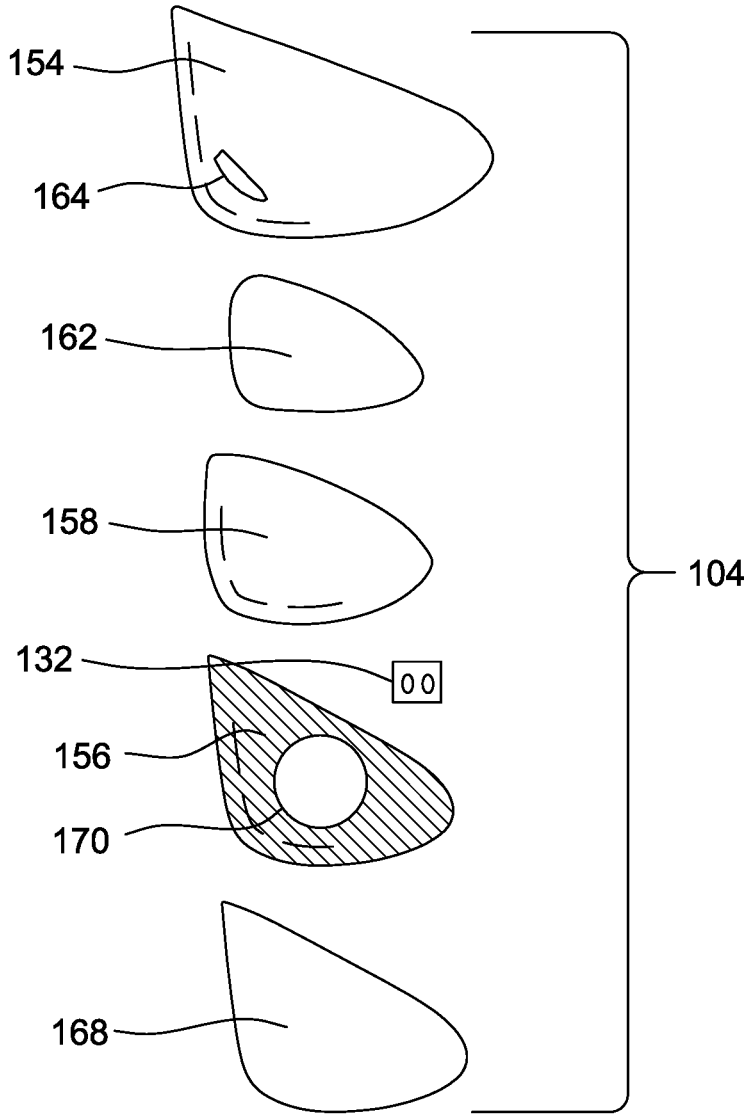
FIG. 6 is an exploded view of the cup shown in FIGS. 4 and 5.

FIG. 4 is front view of the first cup 104 of the nursing brassiere 100. FIG. 5 is a rear view of the first cup 104. FIG. 6 is an exploded view of the first cup 104. The first cup 104 and the second cup 106 (shown in FIGS. 1-3) are identical except for being mirrored about bridge 116 (shown in FIG. 1). Accordingly, the description of the first cup 104 applies to the second cup 106 and vice versa.

In the illustrated embodiment, the first cup 104 is generally oval when the cup is in the support position 120. The first cup 104 includes the lower edge 118, a side edge 177, and an upper edge 178 together defining the generally oval shape of the first cup 104. In the illustrated embodiment, the lower edge 118, the side edge 177, and the upper edge 178 are at least partially curved. The lower edge 118 extends along the band 102 and is arranged to extend underneath the breast. The side edge 177 extends along the band 102 and the strap 108 (shown in FIG. 1) along a side of the breast. The upper edge 178 is arranged to extend across an upper portion of the breast above the nipple. The upper edge 178 extends between the lower edge 118 and the side edge 177 in a generally upward direction. Accordingly, the upper edge 178 and the side edge 177 meet at an apex 180 or high point of the first cup 104. The lower edge 118 and the upper edge 178 meet at a corner that is positioned proximate the bridge 116 when the cup 104 is in the support position 120. The lower edge 118 and the side edge 177 form a continuous curve. In other embodiments, the first cup 104 and the second cup 106 (shown in FIGS. 1-3) may have any shape that enables the nursing brassiere 100 to function as described herein.

The first cup 104 includes an outer layer 154, an inner layer 156, and a liner 158 extending between the outer layer and the inner layer. The inner layer is arranged to contact the skin of the wearer when the brassiere 100 is secured to the wearer. The liner 158 and the outer layer 154 define a first pocket 160 to receive a first pad 162. For example, the first pad 162 may be a brassiere pad and be configured to provide a desired shape of the first cup 104. The outer layer 154 defines an opening 164 for positioning the first brassiere pad 162 into the first pocket 160. The opening 164 may be located at a corner of the first cup 104 spaced from the bridge 116. In the illustrated embodiment, the opening 164 is closer to the lower edge 124 than an upper edge of the first cup 104. The opening 164 and the first pocket 160 allow a wearer to adjust, insert, and/or remove the first brassiere pad 162 while wearing the brassiere 100. In addition, the outer layer 154 is at least partially elastic and retains the first pad 162 within the pocket when the first cup 104 is switched between the support position and the nursing position. In some embodiments, the first pocket 160 may be sized to receive more than one brassiere pad.

The liner 158 and the inner layer 156 define a second pocket 166 to receive a second pad 168. For example, the second pad 168 may be a nursing pad and be configured to absorb fluids. Also, the second pad 168 may be configured to provide a desired shape of the first cup 104. The inner layer 156 defines an opening 170 for positioning the second pad 168 into the second pocket 166. The opening 170 may be located at a middle of the first cup 104 spaced from the upper edge and the lower edge of the first cup 104. The inner layer 156 is at least partially elastic and retains the first pad 162 within the pocket when the first cup 104 is switched between the support position and the nursing position. For example, the inner layer 156 includes an elastic member 172 at least partially defining the opening 170. In some embodiments, the first pocket 160 may be sized to receive more than one pad. In other embodiments, the brassiere 100 may include any pockets that enable the brassiere to function as described.

In the illustrated embodiment, the opening 164 is an elongated slot and the opening 170 is generally circular. The openings 164, 170 may be at least partially defined by flexible material to allow the openings to deform for positioning the pads 162, 168 within the respective pocket. In other embodiments, the opening 170 may have any suitable shape including, for example and without limitation, circular, triangular, rectangular, square, and ovulate.

The first cup 104 and the second cup 106 (shown in FIG. 1) may be constructed of, for example and without limitation, cotton, spandex, nylon, jersey, elastic polyurethane fiber, and/or mesh fabric. In the illustrated embodiment, the outer layer 154 is spandex, the inner layer 156 is an elastic material, and the liner 158 is a mesh fabric.

The inner layer 156, the liner 158, and the outer layer 154 are connected together, e.g., sewn, along their edges. A portion of the connector 130 such as the first clip 132 may be connected to any of the inner layer 156, the liner 158, and the outer layer 154. In the illustrated embodiment, the first clip 132 is attached to and extends between the liner 158 and the inner layer 156. In other embodiments, the first cup 104 may be constructed in other manners without departing from some aspects of the disclosure.

As various changes could be made in the above constructions without departing from the scope of the invention, it is intended that all matter contained in the above description and shown in the accompanying drawings shall be interpreted as illustrative and not in a limiting sense. Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A nursing brassiere comprising:

a band arranged to extend around a body of a wearer and secure the nursing brassiere to the wearer;

a first cup connected to the band and shaped to support a first breast of the wearer when the brassiere is secured to the wearer, wherein the first cup is positionable between a support position, a first nursing position, and a second nursing position, the first cup including a lower edge positioned under the first breast when the brassiere is secured to the wearer and the first cup is in the support position, wherein the lower edge of the first cup is at least partially detached from the band when the first cup is in the first nursing position and the second nursing position;

a second cup connected to the band and shaped to support a second breast of the wearer when the brassiere is secured to the wearer, wherein the second cup is positionable between a support position, a first nursing position, and a second nursing position, the second cup including a lower edge positioned under the second breast when the brassiere is secured to the wearer and the second cup is in the support position, wherein the lower edge of the second cup is at least partially detached from the band when the second cup is in the first nursing position and the second nursing position;

a bridge extending between the first cup and the second cup, wherein the bridge is arranged to align with a sternum of the wearer when the brassiere is secured to the wearer;

a first strap connected to the first cup and the band to form a loop sized to fit over a first shoulder of the wearer;

a second strap connected to the second cup and the band to form a loop sized to fit over a second shoulder of the wearer;

a first coupling member attached to the first cup proximate the lower edge;

a second coupling member attached to the first strap, wherein the second coupling member is arranged to engage the first coupling member and releasably secure the first cup in the first nursing position;

a third coupling member attached to the bridge, wherein the third coupling member is arranged to engage the first coupling member and releasably secure the first cup in the support position;

a fourth coupling member attached to the band, wherein the fourth coupling member is arranged to engage the first coupling member and releasably secure the first cup in the second nursing position;

a fifth coupling member attached to the second cup proximate the lower edge;

a sixth coupling member attached to the second strap, wherein the second coupling member is arranged to engage the fifth coupling member and releasably secure the second cup in the first nursing position;

a seventh coupling member attached to the bridge, wherein the seventh coupling member is arranged to engage the fifth coupling member and releasably secure the second cup in the support position; and an eighth coupling member attached to the band, wherein the eighth coupling member is arranged to engage the fifth coupling member and releasably secure the second cup in the second nursing position.

2. The nursing brassiere of claim 1 further comprising:

a first support portion attached to the band and arranged to extend under the first breast to support the first breast when the first cup is in the first and second nursing positions; and a second support portion attached to the band and arranged to extend under the second breast to support the second breast when the second cup is in the first and second nursing positions.

3. The nursing brassiere of claim 1, wherein the first cup includes an outer layer, an inner layer, and a liner extending between the outer layer and the inner layer.

4. The nursing brassiere of claim 3, wherein the liner and the outer layer define a first pocket to receive a first pad and wherein the outer layer defines an opening for positioning the first pad into the first pocket.

5. The nursing brassiere of claim 4, wherein the opening is closer to the lower edge than an upper edge of the first cup.

6. The nursing brassiere of claim 4, wherein the liner and the inner layer define a second pocket to receive a second pad, and wherein the inner layer defines an inner opening for positioning the second pad into the second pocket.

7. The nursing brassiere of claim 6, wherein the inner layer includes an elastic material at least partially defining the inner opening.

8. The nursing brassiere of claim 4, wherein the second cup includes an outer layer, an inner layer, and a liner extending between the outer layer and the inner layer, wherein the liner and the outer layer of the second cup define a second pocket to receive a second pad.

9. The nursing brassiere of claim 1, wherein the first coupling member comprises a first clip attached to the first cup along the lower edge and the second coupling member comprises a second clip attached to the first strap, the first clip and the second clip arranged to releasably engage and secure the first cup in the first nursing position.

10. The nursing brassiere of claim 9, wherein the third coupling member comprises a third clip arranged to releasably engage the first clip and the fourth coupling member comprises a fourth clip arranged to releasably engage the first clip.

11. The nursing brassiere of claim 10, wherein the fifth coupling member comprises a fifth clip attached to the second cup along the lower edge and the sixth coupling member comprises a sixth clip attached to the second strap, the fifth clip and the sixth clip arranged to releasably engage and secure the first cup in the first nursing position.

12. The nursing brassiere of claim 9, wherein the location of the second clip on the first strap is adjustable.

13. The nursing brassiere of claim 1 further comprising a frame extending through at least a portion of the band.

14. A nursing brassiere comprising:

a band arranged to extend around a body of a wearer and secure the nursing brassiere to the wearer;

a first cup connected to the band and shaped to support a first breast of the wearer when the brassiere is secured to the wearer, wherein the first cup is positionable between a support position and a nursing position, the first cup including a lower edge positioned under the first breast when the brassiere is secured to the wearer and the first cup is in the support position, wherein the lower edge of the first cup is at least partially detached from the band when the first cup is in the nursing position, the first cup comprising:

an outer layer;

an inner layer; and a liner extending between the outer layer and the inner layer, wherein the liner and the outer layer define a first pocket to receive a first pad, the outer layer defining an opening for positioning the first pad into the first pocket, wherein the liner and the inner layer define a second pocket to receive a second pad;

a second cup connected to the band and shaped to support a second breast of the wearer when the brassiere is secured to the wearer, wherein the second cup is positionable between a support position and a nursing position, the second cup including a lower edge positioned under the second breast when the brassiere is secured to the wearer and the second cup is in the support position, wherein the lower edge of the second cup is at least partially detached from the band when the second cup is in the nursing position, the second cup comprising:

an outer layer;

an inner layer; and a liner extending between the outer layer and the inner layer, wherein the liner and the outer layer define a third pocket to receive a third pad, the outer layer defining an opening for positioning the third pad into the third pocket, wherein the liner and the inner layer define a fourth pocket to receive a fourth pad;

a bridge extending between the first cup and the second cup, wherein the bridge is arranged to align with a sternum of the wearer when the brassiere is secured to the wearer;

a first strap connected to the first cup and the band to form a loop sized to fit over a first shoulder of the wearer;

a second strap connected to the second cup and the band to form a loop sized to fit over a second shoulder of the wearer;

a first coupling member attached to the first cup proximate the lower edge;

a second coupling member attached to the first strap, wherein the second coupling member is arranged to engage the first coupling member and releasably secure the first cup in the nursing position;

a third coupling member attached to the bridge, wherein the third coupling member is arranged to engage the first coupling member and releasably secure the first cup in the support position; and a fourth coupling member attached to the band, wherein the fourth coupling member is arranged to engage the first coupling member and releasably secure the first cup in a second nursing position.

15. The nursing brassiere of claim 14, wherein the first cup comprises a first support portion attached to the band and arranged to extend under the first breast to support the first breast when the first cup is in the nursing position and a second support portion attached to the band and arranged to extend under the second breast to support the second breast when the second cup is in the nursing position.

16. The nursing brassiere of claim 14, wherein the opening for positioning the first pad into the first pocket is closer to the lower edge than an upper edge of the first cup.

17. The nursing brassiere of claim 16, wherein the opening for positioning the second pad into the second pocket is closer to the lower edge than an upper edge of the second cup.

18. The nursing brassiere of claim 14, wherein the inner layer of the first cup defines a first inner opening for positioning the second pad into the second pocket and the inner layer of the second cup defines a second inner opening for positioning the fourth pad into the fourth pocket.

19. The nursing brassiere of claim 18, wherein the inner layer of the first cup includes elastic material at least partially defining the first inner opening and the inner layer of the second cup includes elastic material at least partially defining the second inner opening.

* * * * *